US012270559B2

(12) United States Patent
Malekjamshidi et al.

(10) Patent No.: US 12,270,559 B2
(45) Date of Patent: Apr. 8, 2025

(54) SMART AIR PANEL FOR SMART THERMOSTATS

(71) Applicants: Shahriar Malekjamshidi, Shiraz (IR); Ehsan Fattahi, Isfahan (IR); Ali Hoseinzadeh, Isfahan (IR); Eiman Aghababaei, Isfahan (IR); Mojtaba Falahatinezhad, Maple (CA); Nasser Ashgriz, Thornhill (CA)

(72) Inventors: Shahriar Malekjamshidi, Shiraz (IR); Ehsan Fattahi, Isfahan (IR); Ali Hoseinzadeh, Isfahan (IR); Eiman Aghababaei, Isfahan (IR); Mojtaba Falahatinezhad, Maple (CA); Nasser Ashgriz, Thornhill (CA)

( * ) Notice: Subject to any disclaimer, the term of this patent is extended or adjusted under 35 U.S.C. 154(b) by 0 days.

(21) Appl. No.: 18/217,369

(22) Filed: Jun. 30, 2023

(65) Prior Publication Data

US 2025/0003616 A1 Jan. 2, 2025

(51) Int. Cl.
*F24F 11/46* (2018.01)
*F24F 11/54* (2018.01)
(Continued)

(52) U.S. Cl.
CPC ..... *F24F 11/46* (2018.01); *F24F 11/54* (2018.01); *F24F 11/64* (2018.01); *F24F 2120/12* (2018.01)

(58) Field of Classification Search
CPC ..... F24F 11/30; F24F 2110/10; F24F 11/74; F24F 2120/10; F24F 11/56; F24F 11/64; F24F 13/10; F24F 11/46; F24F 13/1426; F24F 11/65; F24F 13/075; F24F 13/082; F24F 13/14; F24F 2221/38;
(Continued)

(56) References Cited

U.S. PATENT DOCUMENTS 5,180,333 A * 1/1993 Shyu ..... F24F 11/56 454/319
5,193,742 A * 3/1993 Byun ..... G05D 23/24 62/186
(Continued)

OTHER PUBLICATIONS

Nasr et al., The impact of facade geometry on visual comfort and energy consumption in an office building in different climates, ScienceDirect, Energy Reports 11 (2024) 1-17 (Year: 2023).*

*Primary Examiner* — Darrin D Dunn
(74) *Attorney, Agent, or Firm* — Nasser Ashgriz; UIPatent Inc.

(57) ABSTRACT

System to control a temperature of a zone in an HVAC controlled space is provide. This system provides a comfort temperature at the location of the user without heating or cooling of the whole space. Therefore, this system can save significant energy by not condition the unwanted zones in a space. The system comprises of a smart air panel installed in the space that has a set of moving louvers, a smart thermostat that controls operation of the HVAC system, a portable tag placed in the zone to measure the zonal temperature and communicate it with the smart air panel and the smart thermostat. A processor is configured to find the location of the tag in the zone and direct the air flow towards that zone. The portable tag sends the zonal temperature to the smart thermostat, which controls the operation of the HVAC system, turning it ON and OFF based on the zonal temperature.

19 Claims, 13 Drawing Sheets

(51) Int. Cl.
*F24F 11/64* (2018.01)
*F24F 120/12* (2018.01)

(58) Field of Classification Search
CPC ..... F24F 2221/14; F24F 7/02; Y02B 20/40; H05K 7/20181; G05B 15/02; G05B 2219/2614; G05B 17/02; G05B 19/042; E06B 2009/6818; E06B 9/68; E05F 15/71; E05F 15/60; E05F 15/70
See application file for complete search history.

(56) References Cited

U.S. PATENT DOCUMENTS 5,251,814 A * 10/1993 Warashina ..... F24F 13/075 454/285
8,180,494 B2 * 5/2012 Dawson ..... G05B 15/02 700/277
8,882,572 B2 * 11/2014 McReynolds ..... G05D 23/27 137/343
8,939,824 B1 * 1/2015 Bash ..... F25D 17/045 62/178
9,862,247 B2 * 1/2018 Perkins ..... B60H 1/00742
9,970,674 B2 * 5/2018 Dow ..... H05K 7/20745
10,527,305 B2 * 1/2020 Lin ..... F24F 11/30
10,626,669 B2 * 4/2020 Lagarde ..... G05B 13/04
10,690,372 B2 * 6/2020 Arens ..... F24F 13/32
10,965,756 B2 * 3/2021 Urquhart ..... H04L 43/16
2004/0262409 A1 * 12/2004 Crippen ..... H05K 7/20836 165/80.3
2005/0155646 A1 * 7/2005 Bash ..... H05K 7/20836 62/132
2006/0091229 A1 * 5/2006 Bash ..... F24F 11/70 62/186
2010/0071856 A1 * 3/2010 Zaharchuk ..... E05F 17/00 160/5
2012/0003918 A1 * 1/2012 McReynolds ..... F24F 13/1426 454/313
2014/0156083 A1 * 6/2014 Burke ..... G05B 15/02 700/276
2014/0265021 A1 * 9/2014 Wessel ..... E06B 3/673 264/261
2016/0196738 A1 * 7/2016 Viggedal ..... G08B 25/002 340/506
2018/0355660 A1 * 12/2018 Noy ..... E05F 15/641
2020/0267822 A1 * 8/2020 Casey ..... H05B 47/11
2023/0065864 A1 * 3/2023 Trikha ..... G01D 18/00
2023/0111256 A1 * 4/2023 Looy ..... B60H 1/00871 454/75
2023/0258365 A1 * 8/2023 Hisano ..... F24F 11/79 454/284
2023/0359979 A1 * 11/2023 Hamm ..... G06Q 10/0833

* cited by examiner

FIG. 9A
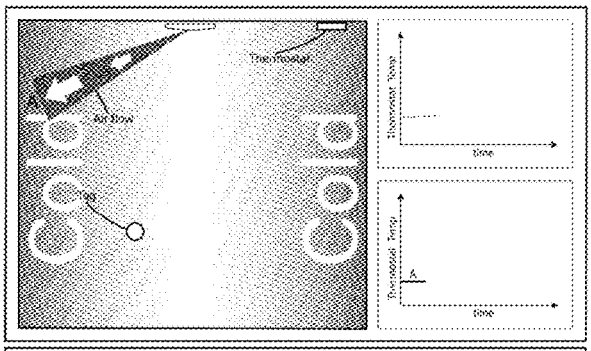
FIG. 9B
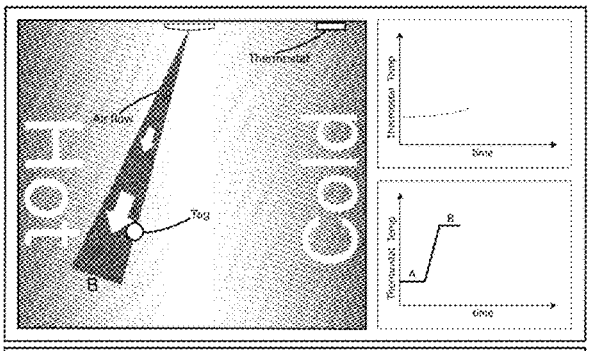
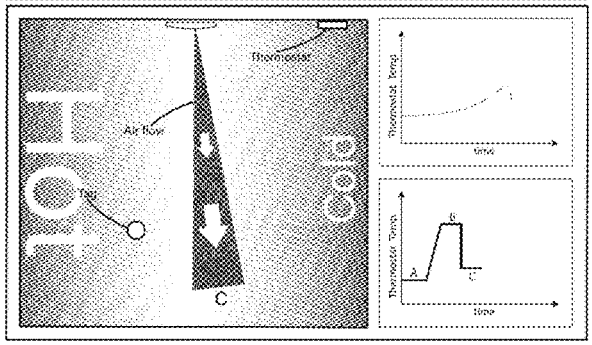
FIG. 9C
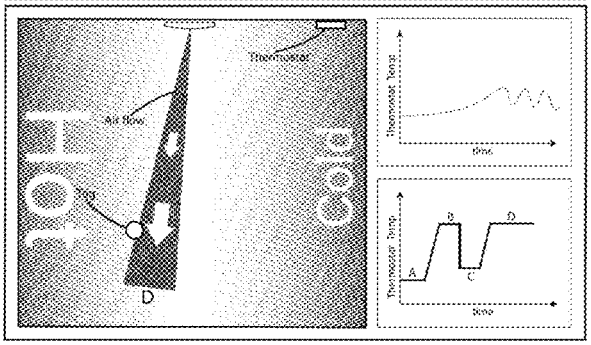
FIG. 9D

SMART AIR PANEL FOR SMART THERMOSTATS

FIELD OF INVENTION

The present system generally relates to heating, ventilating, and air conditioning (HVAC) systems, and specifically to controlling a zonal temperature using an air panel with movable louvers.

BACKGROUND OF THE INVENTION

Energy consumption for heating and cooling of indoor spaces accounts for more than 40% of global total energy consumption. In North America, 6% of the total electricity produced is used by the HVAC systems in household, with an annual cost of more than $30 Billion and production of more than 120 million metric ton of $CO_2$. With the current energy scarcity and concern for environmental issues, any reduction in energy consumption is a significant contribution to our future survival.

Most homes have a single-unit central HVAC system with one (or occasionally more) thermostats. Condominiums may have several smaller HVAC systems, each controlled by a thermostat of its own. The thermostat is usually placed on one of the walls of the main space. The desired temperature is set on the thermostat by the user. The temperature sensor inside the thermostat reads the air temperature around the thermostat and if it does not match the set temperature, it turns the HVAC system ON and OFF. The electricity cost of running an HVAC depends on how long the HVAC is on. With a thermostat installed on the wall, the temperature around the thermostat is controlled. The temperature around the user may be different than that around the thermostat. Therefore, the user adjusts the thermostat temperature setting until a desired comfort level is obtained. This usually occurs when the whole space comes to an equilibrium temperature, where there is little difference between the temperature around the thermostat and that around the user. For this to happen, the HVAC system remains on for a long time (longer than necessary).

The present system is provided to keep the thermostat on for a shorter period of time and therefore save energy.

SUMMARY OF THE INVENTION

The present system can measure a zonal temperature in a space or a room, and control that zonal temperature, rather than the temperature around a thermostat. Our system includes a tag that is equipped with a temperature sensor to measure the zonal temperature and a smart air panel for the HVAC system with the ability to change the direction of the output airflow.

The present system targets the air directly or indirectly towards a tag location and turns the HVAC on and off based on the temperature around the tag. If the person carries the tag, then the temperature around the person can be controlled. The tag can also be placed at any desired location in the space to control the zone around the tag. Therefore, the present system does not condition the air in the whole space, but only around the user carrying the tag.

Some smart phones have a temperature sensor, which can be used as well. In such conditions, the smart phone will act as the tag.

The smart panel communicates with the tag; temperature sensor of the tag measures the zonal temperature and communicates it with the smart thermostat, which controls the HVAC system.

The present system also has a mobile phone application that when installed on the phone, it can be used to change the temperature setting for the zonal temperature from the phone.

The present smart air panel comprises of a set of movable louvers. These louvers are controlled by a processor, which can move the louvers to direct the air to any desired direction.

The smart air panel is configured to scan the space and find the location of the tag in a space. The search is based on moving the louvers side to side, while receiving temperature information from the tag (temperature sensor) that is placed inside the space. When the hot or cold air of the air panel passes over the tag (temperature sensor), the sensor reads a zonal temperature. That temperature is provided to the smart panel through a wireless communication. Zonal temperature gradient is calculated by the processor in the smart panel. The louvers are then stopped at the location where the temperature gradient changes significantly. Since there is a time delay between the air exiting the panel and air arriving at the location of the temperature sensor (tag), the louver location is adjusted to that time delay. The louvers may be moved back and forth to find the location with the highest temperature gradient.

One objective of the present invention is to reduce energy consumption of HVAC systems for heating and cooling of all indoor spaces.

Another objective of the present system is to control the temperature only in a specific region of a space where it is needed, and do not control other spaces.

Another objective of the present system is to provide a smart air panel that can target the air in any desired direction.

Another objective of the present system is to provide a system and method that enables heating and cooling of a space more efficiently and most cost effectively.

BRIEF DESCRIPTION OF THE DRAWINGS

The following figures show the essential elements of the present invention.

FIG. 9A-D show the temperature inside a space as the smart air panel scans the room.

DETAILED DESCRIPTION OF THE INVENTION

Figure 1:
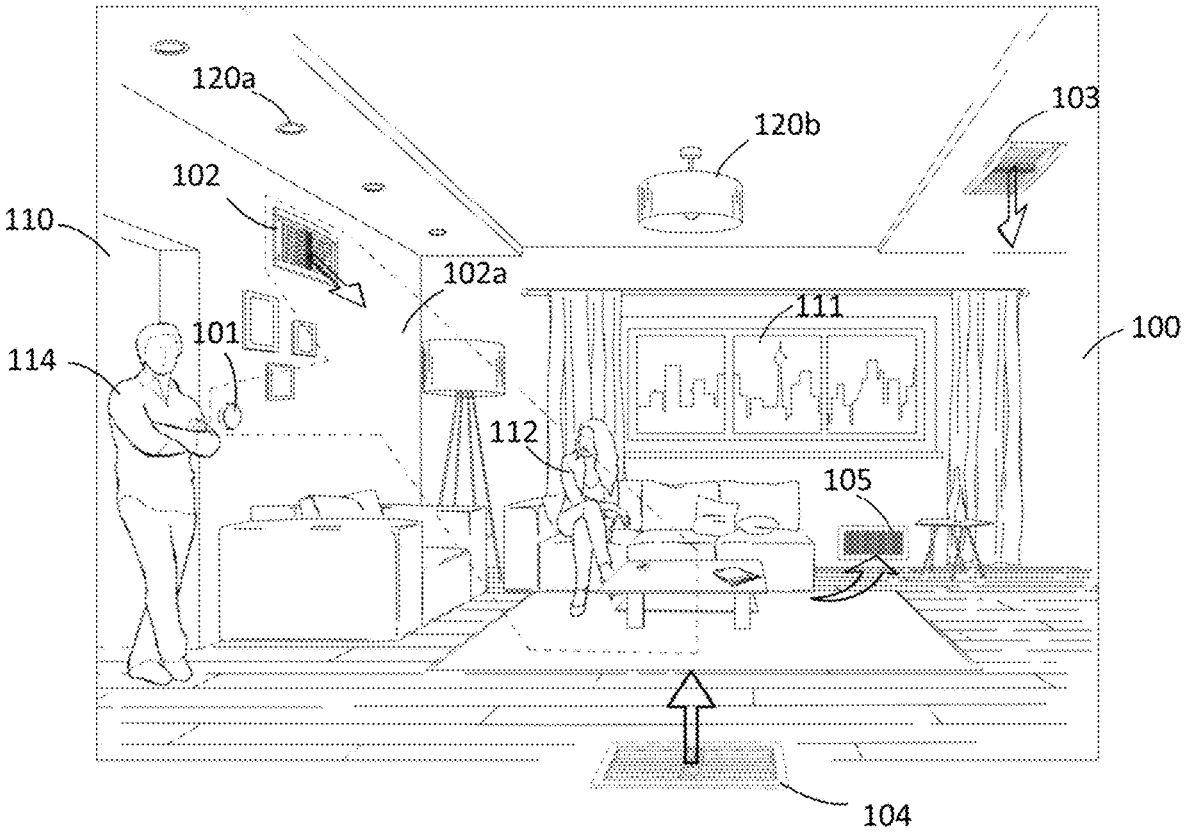
FIG. 1 illustrates a room with multiple air vent panels and a thermostat to control the temperature of the room.

FIG. 1 shows a living space 100 that has an HVAC (not shown) system to control the temperature inside the space. A typical HVAC system is operated by a thermostat 101 that is installed on a wall. The space generally has one or more air panels depending on the size of the space, that may be installed at different locations. For example, FIG. 1 shows three outlet air panels, one on the wall 102, one on the ceiling 103, and one on the floor 104, that provide hot or cold air into the space. The air panels usually have manually moveable louvers that one can target the air flow in a certain direction or make it diffuse more. For example, the louvers on air panel 102 are set to flow the air into zone 102*a*. The air then impinges on different surfaces and spreads into other areas of the space. After a certain period of time, the air temperature in other areas changes based on their boundary conditions, namely vicinity to a door 110, a window 111, or other heat sinks or sources, such as lights 120*a* and 120*b*.

The HVAC system also has a return air panel 105, to take the room air back to the HVAC for cooling or heating. HVAC is turned on and off when the temperature reading by the thermostat 101 goes above or below of a temperature that is set by the user.

Because of the heat loses (or gains) from (into) the space, the temperature of the room is usually not uniform. For example, in the winter time, when the outside temperature is cold, the air temperature inside the space and close to a window 111 may drop faster than other zones in the space. Therefore, a person 112 sitting close to the window 111 may feel cold, while the person 114 away from the window may be comfortable. If the thermostat is set such that the person 112 close to the window feels comfortable, the person 114 away from the window may be too hot. This basically indicates overheating or overcooling of a space depending on which zone of a space is being controlled, which results in inefficient use of HVAC system, and therefore, more energy consumption.

The present system is designed to control the temperature of a desired zone in a space, thereby, it not only provides a better thermal comfort for the user, but also lowers energy consumption and cost. This is achieved using (i) a smart air panel, (ii) a portable tag having a temperature sensor, (iii) a smart thermostat, and (iv) a processor configured to control the system.

Smart Air Panel

Figure 2A:
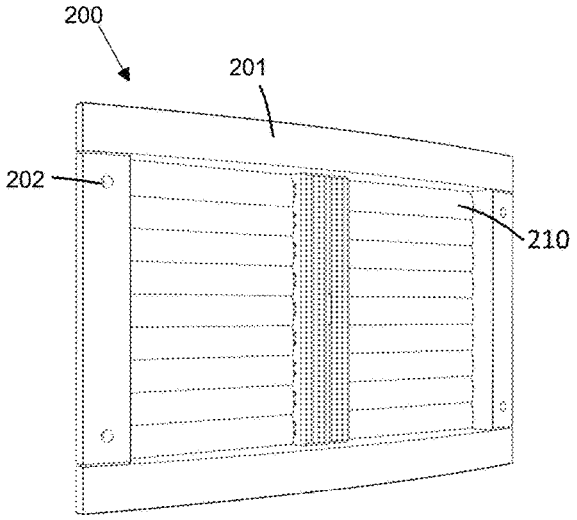
FIG. 2A shows the front side of the first embodiment of the smart air panel.
Figure 2B:
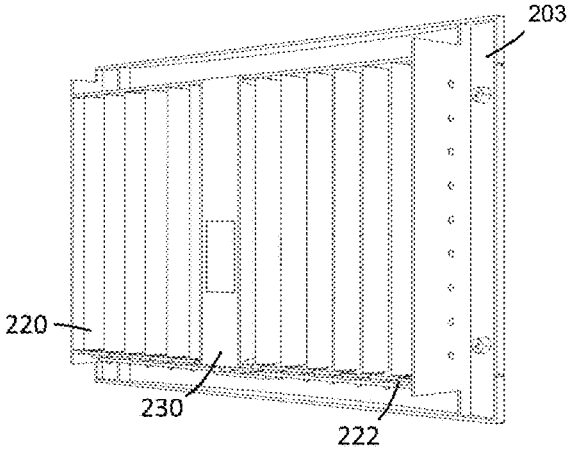
FIG. 2B shows the back side of the first embodiment of the smart air panel.
Figure 3:
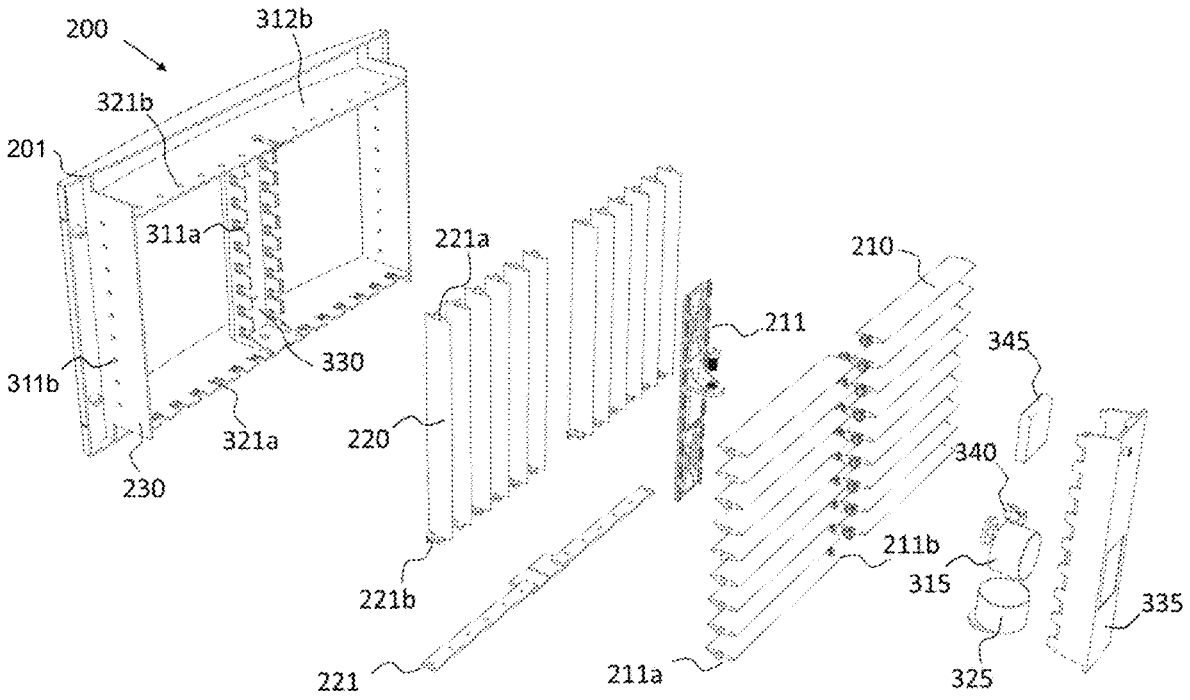
FIG. 3 shows the exploded view of the first embodiment of the smart air panel.

FIGS. 2A and 2B and FIG. 3 show the front and back sides of the smart air panel 200, respectively. The front side has a panel cover 201. The panel cover can be replaced using different aesthetic designs to match different home designs. In one embodiment, the cover has apertures 202 for installation on the main body 203 of the air panel. The panel cover may be magnetic to magnetically stick to the main body. The smart air panel 200 has a set of horizontal louvers 210, and a set of vertical louvers 220. Rotating mechanisms, installed on the air panel rotate the louvers. A vertical rotating mechanism 221 is configured to rotate the vertical louvers 220, and the horizontal rotating mechanism 211 is configured to rotate the horizontal louvers 210.

FIG. 3 shows the exploded view of the smart air panel 200. Panel body 230 is configured to receive the horizontal louvers 210 and the vertical louvers 220. Louvers have side pins 211*a*, 211*b*, 221*a*, 221*b*, that are places in corresponding apertures 311*a*, 311*b*, 321*a*, 321*b* of the panel body, respectively. The rotation mechanism is configured to rotate the louvers. A first motor 315 rotates the horizontal louvers 210, and a second motor 325 is configured to rotate the vertical louvers 220. In the first embodiment of the present system, the motors are placed in a central section of the body 330 and covered with a motor cover 335. The motor 325 moves a rotation transferring lever 221, which in turn rotates the vertical louvers. Similarly motor 315 moves rotation transferring lever 211, which rotates the horizontal louvers. A microswitch in communication with the processor 345 controls the operation of the motors and louvers.

Figure 4A:
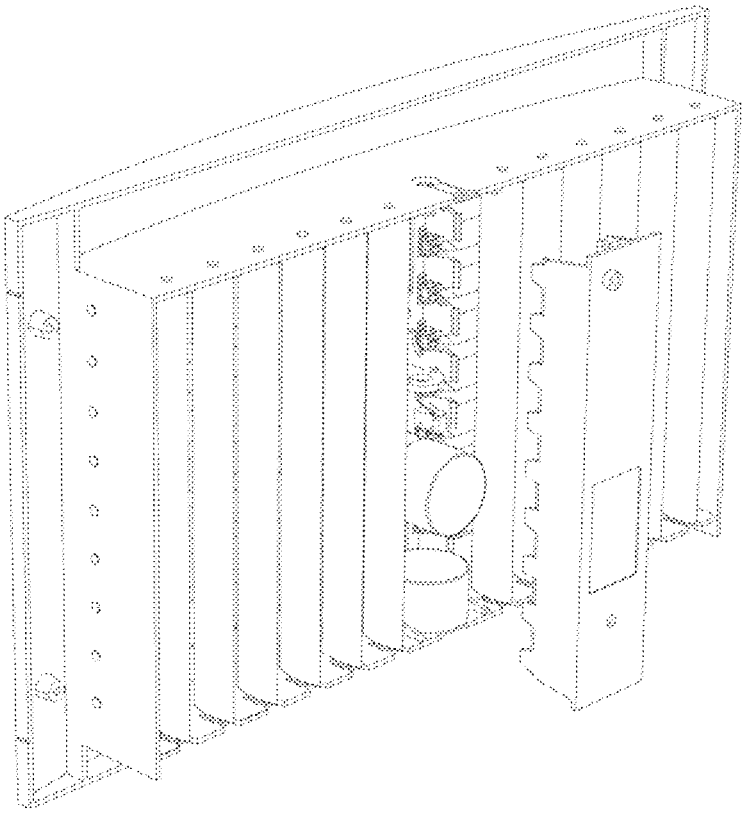
FIG. 4A shows the first embodiment of the smart air panel with a control compartment placed on the inner side and at the central part of the air panel.
Figure 4B:
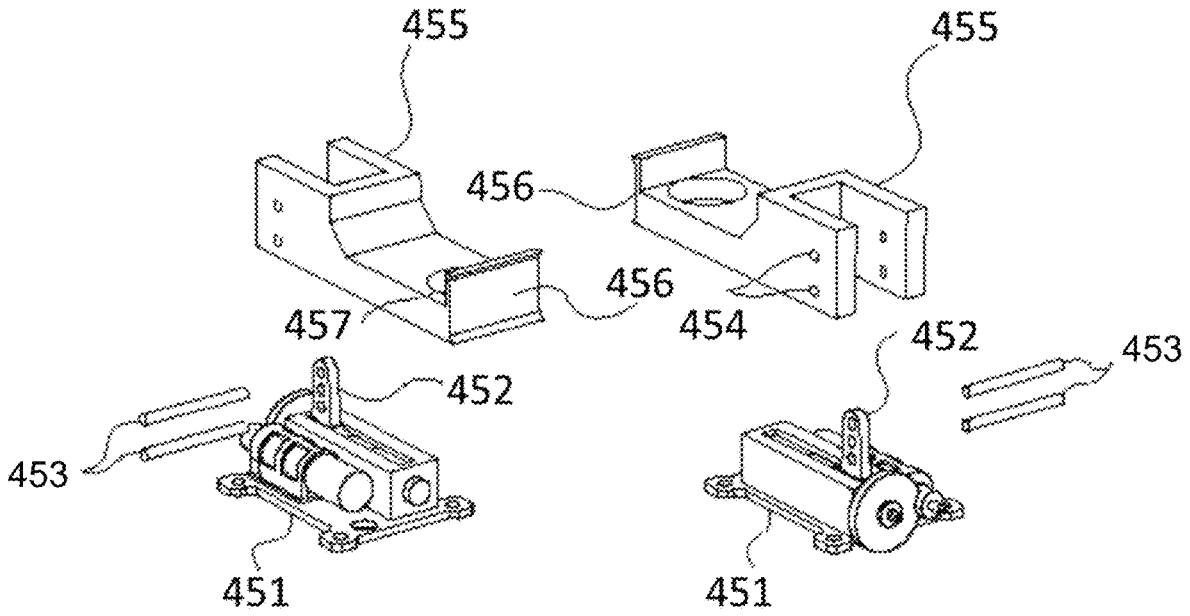
FIG. 4B shows the moving mechanism of the first embodiment of the smart air panel.

The processor 345 located inside the panel controls the movement of the louvers. The processor may also be placed outside of the smart air panel and inside the portable tag and remotely communicates with motors as well as communicate with the tag (a temperature sensor) that is carried by the user or placed in a location in the room where the temperature control is desired. The processor also communicates with a smart phone that has an application installed in it to allow the user to manually and wirelessly move the louvers to any desired direction. The smart air panel can be battery powered, or plugged into an AC outlet, or having a solar cell on its front surface. In one embodiment, the processor with its control and communication system is placed in the central compartment in the smart panel, between two sections of the set of horizontal and vertical louvers. FIG. 4A shows the positioning of the motor in the air panel and FIG. 4B shows the connecting mechanisms of the motor to the moving mechanism. In one embodiment of the present invention, a linear micro motor 451 is used. The micro motor is connected to the lever 455 through a connector 452. Pins 453 are used to connect micro motor 451 to lever 455 and also through apertures 454. The lever has a grip 456 that is used to connect to strings for movement of the louvers. An opening 457 is provided to allow using a connecting mechanism to connect the lever to the micro motor.

Figure 5A:
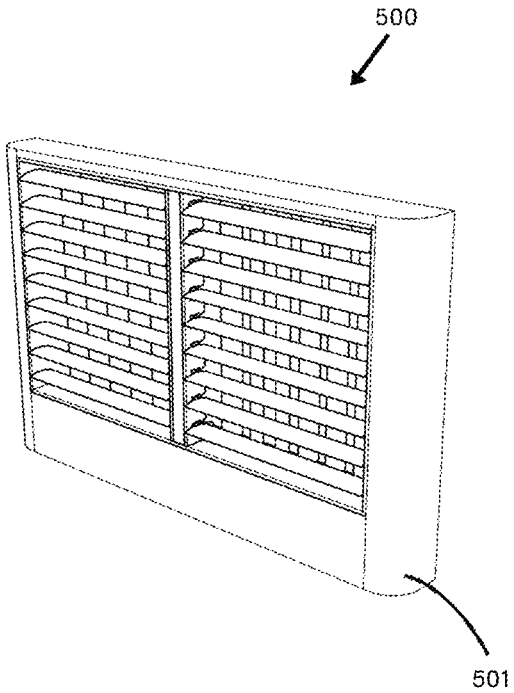
FIG. 5A shows the front side of a second embodiment of the smart air panel with the control compartment placed outside and on the side of the air panel.
Figure 5B:
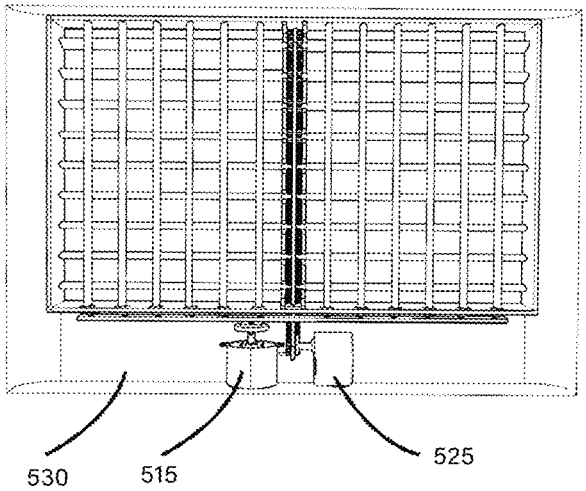
FIG. 5B shows the back side of the second embodiment of the smart air panel with the control compartment placed outside and on the side of the air panel.

FIGS. 5A and 5B show a second embodiment of the present smart air panel 500, in which the motors, 515, 525 and the control and communication system are placed in the side compartment 530 of the panel. In this embodiment, the main body 501 of the panel sits outside of the wall and not inside the air duct.

Figure 6A:
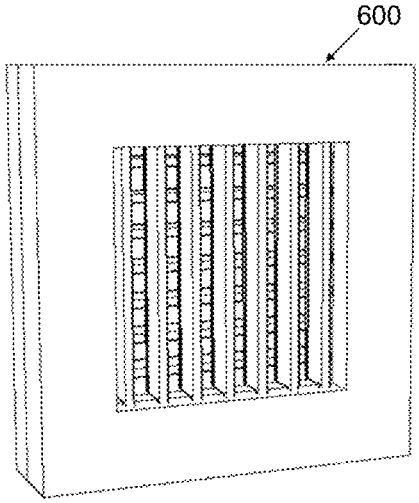
FIG. 6A shows the front side of a third embodiment of the smart air panel with a rack and gear moving mechanism.
Figure 6B:
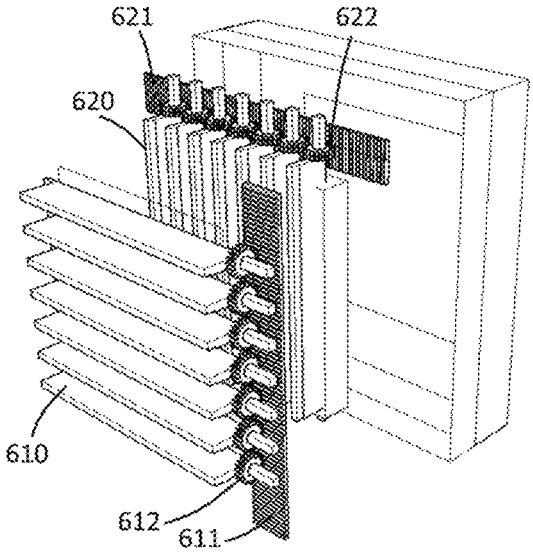
FIG. 6B shows the back side of a third embodiment of the smart air panel with a rack and gear moving mechanism.

FIGS. 6A and 6B show a third embodiment of the present smart air panel 600, in which the rotating mechanism comprises of a rake-and-pinion system. The system consists of a rake plate that is located on two sides along the length of the gear, which converts the rotational movement from the coupling into a linear movement, and by gears that are installed at the end of the horizontal louvers, the linear movement is converted back into louver movement. The linear moving geared plates, 611 and 621, engage with the gears 612 and 622 on the horizontal 610 and vertical 620 louvers, respectively. When the linear geared plates 611 and 621 move back and forth, the louvers 610 and 620 respectively move along with them.

It is understood that a variety of moving mechanisms, including screw-gear or a gear-and-belt mechanisms can also be used to control the movement of the louvers.

The air panel comes in different sizes to fit most currently used air panels. The standard air panel sizes include 4×14, 6×14, 8×10, 8×12, 8×14, 10×10, and 12×12, inches. However, it is understood that any size air panel can be made. Users simply replace their existing air panels with a smart air panel. There is no need for any structural changes.

Portable Tag (Temperature Sensor)

Figure 7A:
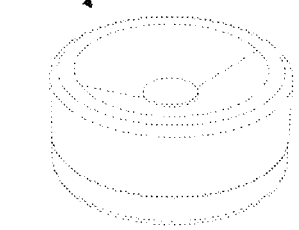
FIG. 7A shows a perspective view of a tag of the present system.
Figure 7B:
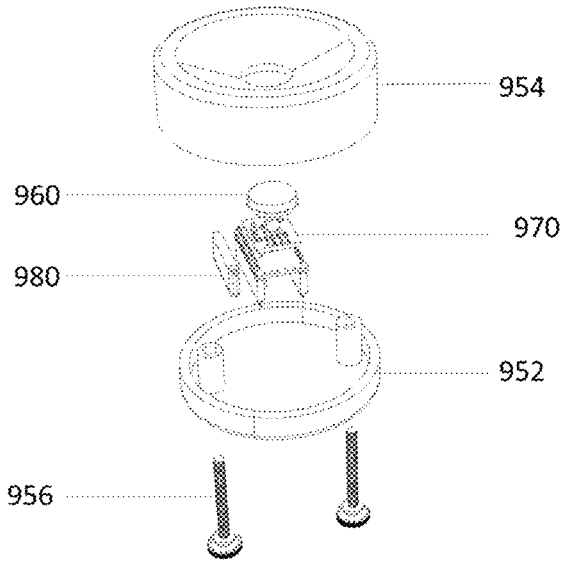
FIG. 7B shows the exploded view of the tag of the present system.

A portable tag 950 as described in FIGS. 7A and 7B is a portable device that comprises of a temperature sensor 960 and a communication system 970, such as a Bluetooth and a battery 980. All parts of the tag are placed in a compartment 952, 954, 956. The tag is paired to the smart air panel, a smart thermostat, and a mobile phone. The tag is carried by a user or placed in a desired location to measure the temperature of that location. The temperature data is sent to the smart air panel, the smart thermostat, and the mobile application.

In another embodiment of the present system, the tag may have control keys to move the set of horizontal and vertical louvers, thereby it acts as a remote control for the panels. In this case, if the user does not have a mobile phone, user can set the air direction using the tag.

Smart Thermostat

The present system uses a smart thermostat (not shown) that controls the HVAC system. The main purpose of using a smart thermostat is its ability to communicate with other devices, including the tag and a mobile phone.

Smart thermostats allow users to save on energy costs by controlling their space heating or cooling from a mobile device. One can check the thermostat remotely while away. The main features of the smart thermostat include its remote control by mobile phone, easy connection instead of old thermostats, HVAC monitoring, and voice control.

Finding the Tag

The main purpose of the smart air panel is to find the tag and control the temperature around the tag. In order to find the tag, the air panel sweeps the space by moving the louvers. The process of finding the tag is presented in FIGS. 8 and 9A-D.

FIGS. 8 and 9A-D show a tag placed inside a space that has a smart air panel and a smart thermostat. In the case shown, the space is initially cold and hot air is let into the air by the air panel to heat the space. Initially, the air panel does not know the location of the tag. In order to find the tag, the air panel sweeps the space, turning the louvers towards the left wall and slowly rotating the louvers towards the right wall. During this process, the air panel continuously received the temperature of the tag. FIG. 9A shows that the tag temperature is at the room temperate since the hot air has not reached the tag yet. As louvers rotate, the hot air eventually reaches the tag, and tag send a higher temperature to the smart air panel. This is shown in FIG. 9B. As the louvers rotate more the tag temperate may drop. This will indicate that the louvers have passed the tag location, as in FIG. 9C. Then, the system control turns the louvers towards the left wall until the tag temperature goes up again, as FIG. 9D. This control system has an optimization algorithm to find the tag location rapidly and efficiently. Classic mathematical and metaheuristic algorithms find the tag location rapidly. It is understood that the scanning processes can be in a variety of forms, and it can be optimized to find the tag location immediately.

Prior locations of the tag are saved in the processor, and the scanning process can start from one of the prior locations to expedite the finding the tag location. The prior locations may also be named to correspond to a specific user if the user would normally sit in that location. In such cases the processor immediately set the louvre to the direction of the set user.

The air sweep can be performed first with the vertical louvers and then with horizontal louvers, or vice versa.

Figure 8:
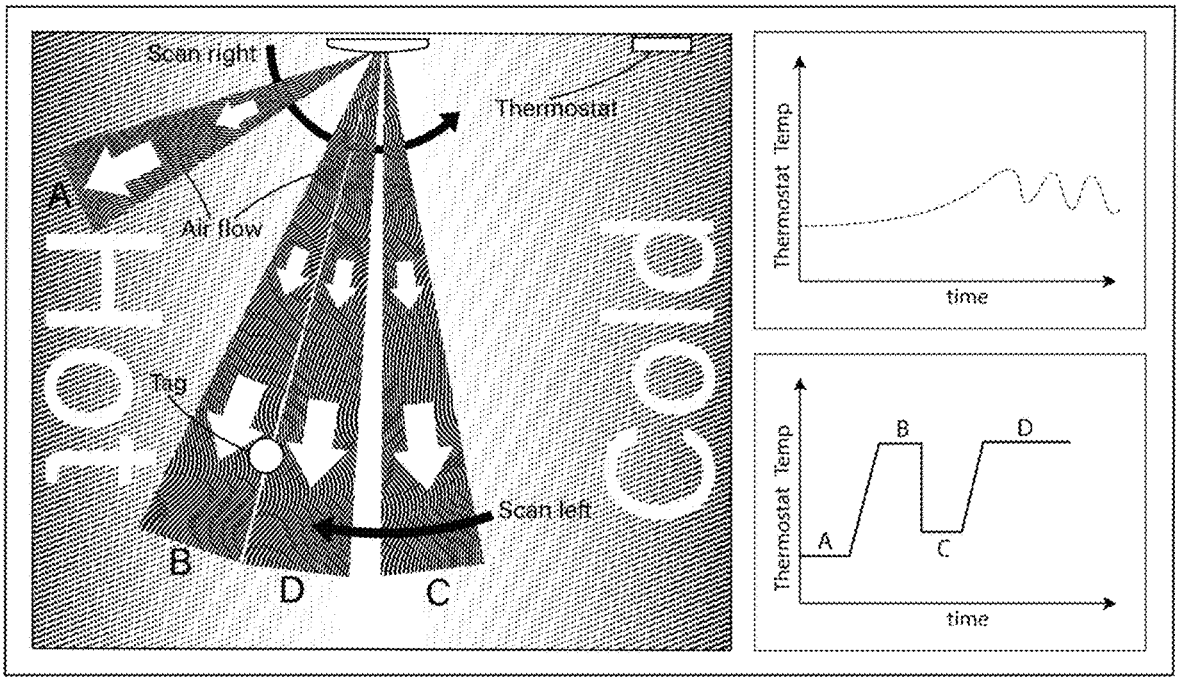
FIG. 8 shows the scanning process of the smart panel through a space.

The present system provides a more stable zonal temperature with smaller fluctuations, as compared to a thermostat-controlled system, as shown in temperature diagrams of FIG. 8.

Figure 10:
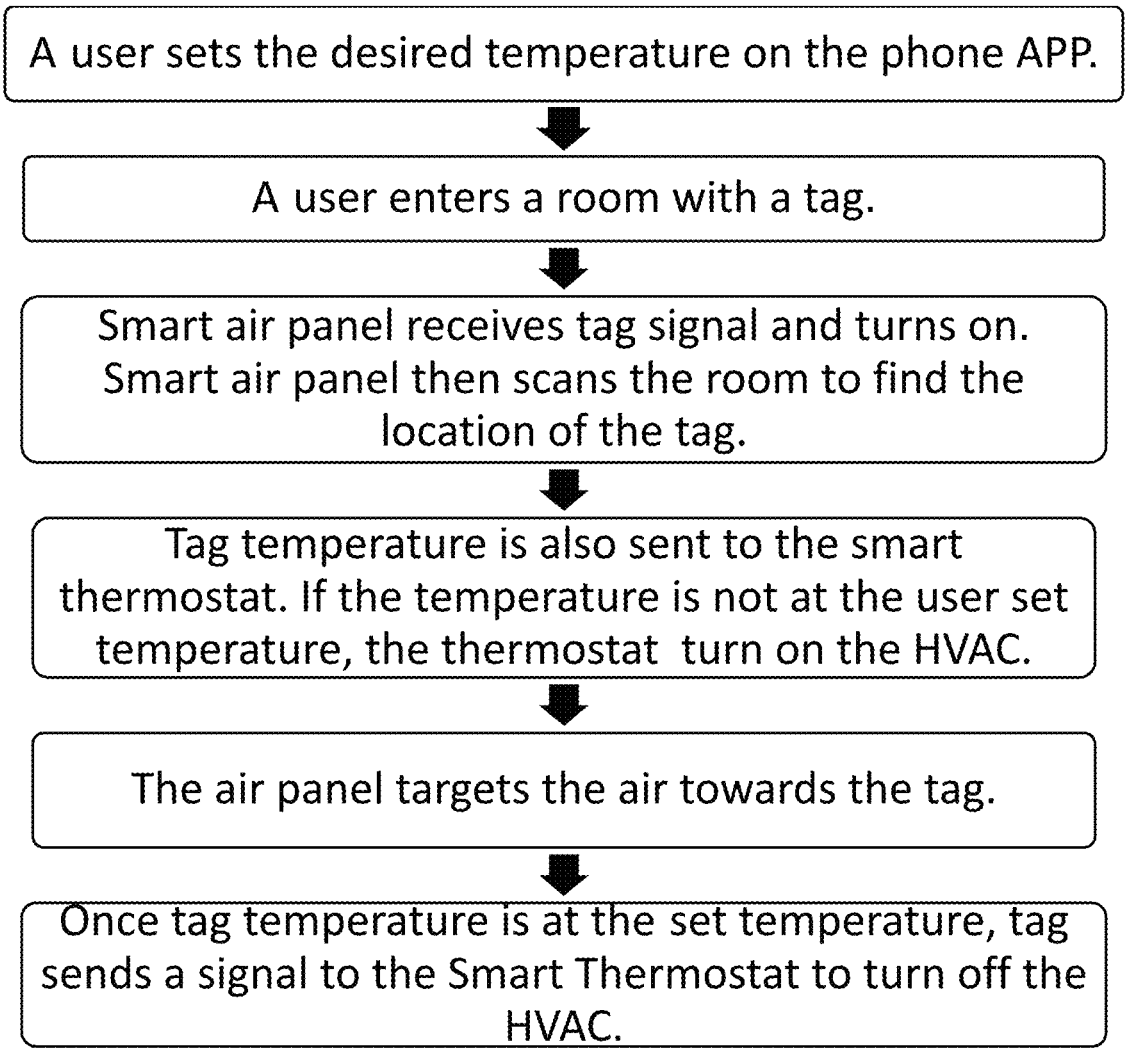
FIG. 10 shows the steps of the scanning process.
Figure 11:
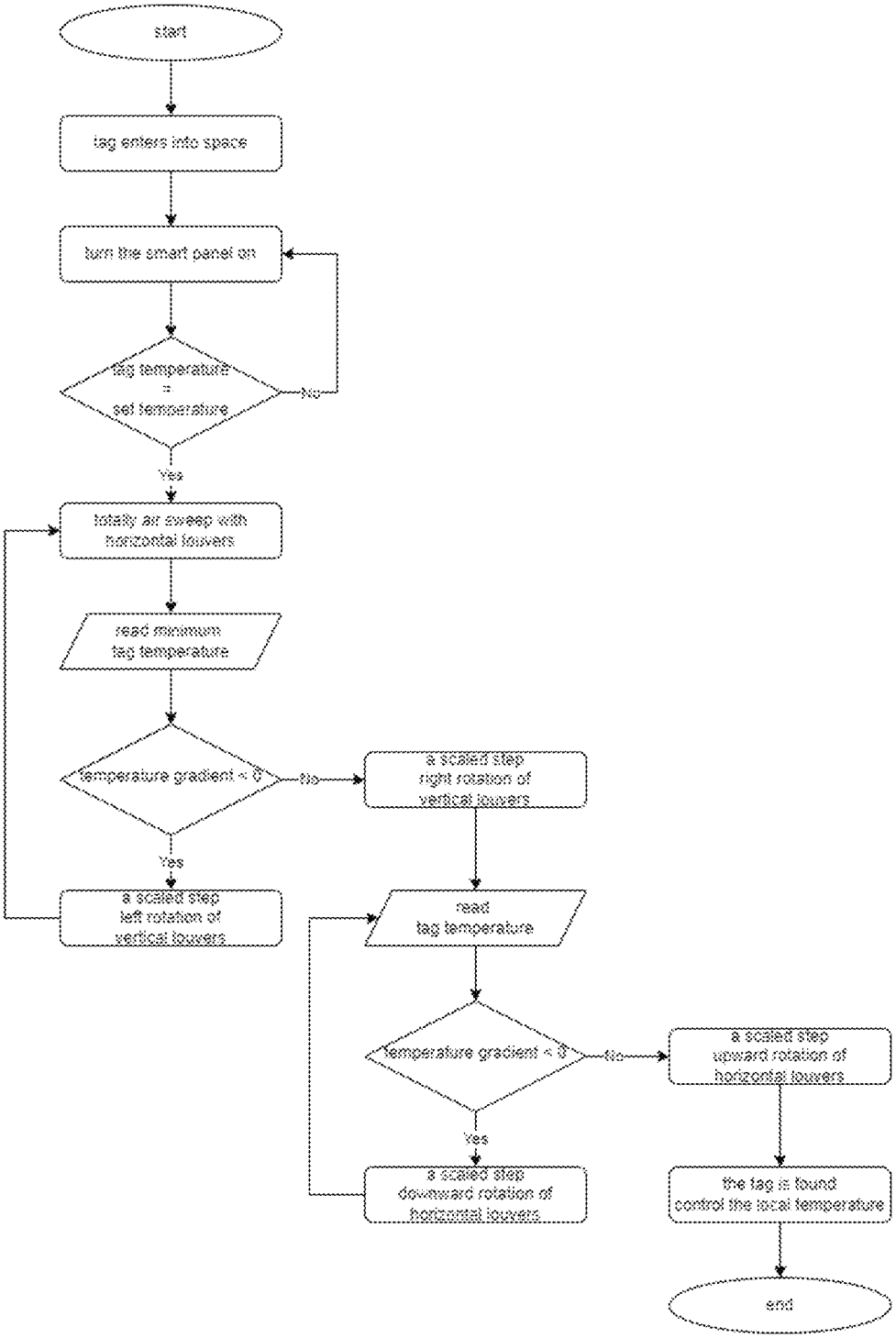
FIG. 11 shows the flow chart of the scanning process.
Figure 12:
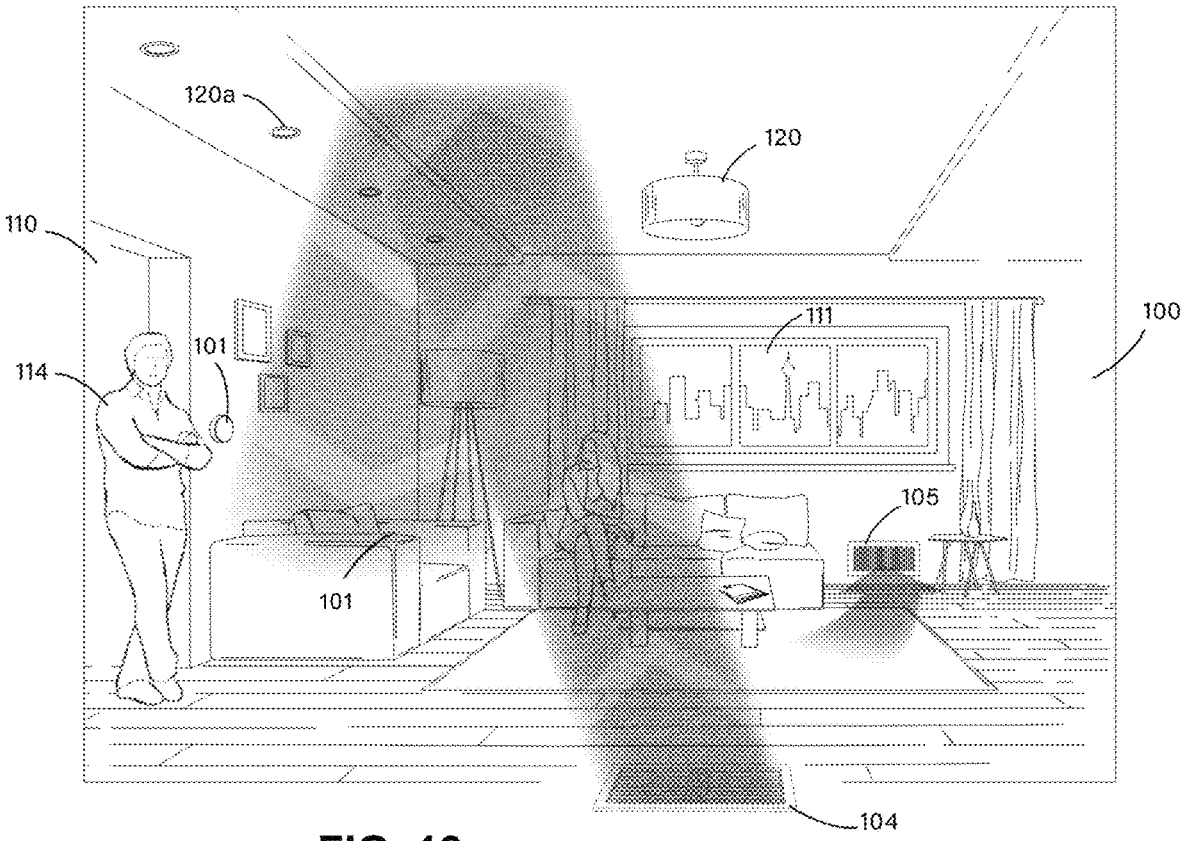
FIG. 12 shows the air flow path inside the room when the smart air panel find a target.

FIGS. 10 and 11 show the operation of a system. A user sets the desired temperature on his/her phone app. Once the user enters the room that has a smart air panel, the smart panel receives a signal from the phone that a user has entered the space. The smart air panel scans the room to find the location of the tag that is being carried by the user or is installed on his/her phone. Tag temperature is also sent to the smart thermostat. If the temperature is not at the user set temperature, the thermostat turns on the HVAC. The air panel targets the air towards the tag. Once the tag temperature is at the set temperature, tag sends a signal to the smart thermostat to turn off the HVAC.

The HVAC remains off until a tag enters a zone that is controlled by the smart panel. The smart panel remains on standby as long as the tag is outside of the active region of the tag. During the standby the louvers are closed. Therefore, even if the HVAV may be on in the building or a space, the louvers of the panel that is controlled by the tag is closed. Once the tag enters the active zone, the smart panel is activated and the louvers of the panel start the process of search.

The tag location search process comprises of the following steps in a cooling process.

First the vertical louvers are set at central position and horizontal louvers are set at far top position, and then with the HVAC on, the tag temperature is recorded at a steady state condition (after having HVAC operate long enough that room has reached a steady condition).

Then, the horizontal louvers scan the space from top to bottom, for a full vertical scan. During this process, the tag temperature is recorded, and the minimum tag temperature is determined.

Then the gradient of minimum tag temperature is determined by the difference between the present and past minimum tag temperatures.

If the gradient of the recorded minimum tag temperature is negative, that means that the tag temperature is decreasing and there may be a lower point. That is the goal in cooling process. Therefore, the vertical louvers are turned by a step angle (the step angle is a predefined angle of louvers) to the left. Then steps 2, 3 and 4 are repeated until the gradient of the minimum tag temperature is positive.

If the gradient of the recorded minimum tag temperature is positive, that means that a previous tag temperature was lower, and the louvers have passed the minimum point. Then the vertical louvers are turned by a step angle (the step angle is a predefined angle of louvers) to the right and go to step 6.

The vertical louver angle that provides the minimum tag temperature, corresponds to the horizontal location of the tag in the space. Horizontal location of tag in the space is found by the smart panel.

With the fixed vertical louver angles, the horizontal louvers scan the space to find the minimum tag temperature at a point that negative gradient converts to positive gradient.

The louvers angles so obtained provided the minimum air temperature to the tag location.

The step movements can be controlled from one to several degrees. For a 10 degree step movement, it takes 12 steps tor 120 degree steps. FIG. 11 is flow chart of the operation of these systems.

The zonal temperature minimum is found based on the descending gradient algorithm. The desired temperature is defined by smart thermostat. When the tag enters into the HVAC controlled space, turn the smart air panel on. Then tag reads the local temperature. If it match the desired temperature so the zonal temperature level is comfortable. But if it does not match the set temperature, smart thermostat turn the HVAC system on. Temperature of any zone that is located in the direction of the HVAC air flow, tends to the proper temperature depends on heating or cooling mode. So, if the direction of smart air panel is around the tag, the temperature of that zone tends to proper temperature and if the direction of smart air panel is far from the tag, the temperature of the zone tends to the temperature of the room or there will be no noticeable change in the temperature. To find the location of tag, by changing the smart air panel direction, tag measures the temperature gradient and by optimizing this temperature, smart air panel finds the tag. So, finding the location of tag by smart air panel is modeled to the algorithm of optimizing the temperature of the tag by varying the air panel direction. The optimization algorithms consist of two main categories, i.e., classic mathematical and metaheuristic algorithms. In these algorithms, changing the air flow direction continues until the temperature of the tag reaches the extremum value of itself, which is exactly the goal of this patent.

In the present system, there is no need to control the temperature of the whole room. Therefore, there will be significant energy savings. When the temperature of the area reaches to a desired temperature, the smart thermostat turns off the HVAC system. Therefore, it is possible to significantly reduce the cost and energy by reducing the time that the HVAC system is on.

Conventional HVAC systems operate based on communication between a thermostat and the HVAC. The thermostat measures the temperature and turns the HVAC on and off. Smart thermostats operate based on communication between an App on a smart phone and the smart thermostat, which communicates with the HVAC. This allows for the users to set the temperature remotely and using their phone App. The present system operates based on a communication between a smart air panel that has electronically controlled louvers; the smart air panel communicates with a portable tag (a temperature sensor) carried by the user; the tag communicates with a smart thermostat, which communicates with both an App and the HVAC. The smart air panel finds the tag and directs the air in that direction. This technology saves significant amount of energy, which is made possible by the addition of two novel concept to the HVAC system, namely, the smart air panel and the portable tag. In addition, the location of the tag is obtained using a scanning by louver movement, and without the use of costly camera and image processing system. This keeps the cost of the whole system low, such that it pays for itself within only a few months by saving in the energy cost.

The smart air panel can be programmed to close the louvers if no tag was found in the space. This prevents air conditioning of a space that there is no one in it, thereby saving energy. For instance, when the residences of a home are in their bedrooms, and there is no one in the living room, the living room louvers close, and the HVAC is used to condition only the bedrooms. If each bedroom has its own smart air panel, then the louvers of the bedroom that is empty will be closed. The smart air panel allows homeowners to save on energy costs by controlling their home's heating or cooling and automatically control different areas of the home.

Manual Louver Control

The smart air panel is also equipped with an RF or IR receiver to remotely control the louver movement. The RF remote can be used to rotate the louvers either clockwise or counterclockwise with the use of this receiver. This receiver's RF remote has a higher range than IR remotes, which is one of its many important advantages over receivers with IR remotes.

Six keys on the receiver's remote control allow the user to turn off and, on each channel, using the keys A through D. Therefore, the direction of the horizontal and vertical louvers can be switched between clockwise and counterclockwise by using the A-D keys. The desired channel's status changes each time the key is pressed. To connect and disconnect all channels, there are two main ON and OFF keys. Therefore, the user can direct the louvers in the desired direction with this remote.

Thermal Camera

In another embodiment of the same device, a thermal camera is installed on the smart air panel. The thermal camera can take a thermal image of the whole space. The thermal image is sent to the processor, which performed an image analysis and determines the location(s) of thermal zone(s). The image analysis then determines if any of the thermal zone is people. The processor then resolved the location of the people found by the thermal camera with that of the tag. If the location is the same, then the thermal control will continue as before. If there another location, then there may be other people in the room. The processor then performed intermittent heating/cooling of both or many zones, by moving the panels to each of the zones in a periodic manner. The heating/cooling of the zones is performed until the temperature of those zones reach the desired temperature.

The invention claimed is:

1. A zonal temperature control system to control a zonal temperature of a zone in a space having an HVAC system, comprising:

a) a smart air panel installed in the space, having a set of moving louvers;

b) a smart thermostat that controls operation of the HVAC system;

c) a portable tag placed in the zone to measure the zonal temperature and communicate the zonal temperature with the smart air panel and the smart thermostat, and d) a processor installed in the smart air or in the portable tag, configured to command the smart air panel to scan the space by moving its set of moving louvers and find a location of the portable tag in the space based on changes in the zonal temperature as measured by the portable tag, and fix air flow from the smart air panel towards the portable tag, e) whereby the zonal temperature is controlled by air flow directed towards the zone in the space by the smart air panel, and the portable tag sends the zonal temperature to the smart thermostat, which controls the operation of the HVAC system, and whereby the HVAC system is turns ON and OFF based on the zonal temperature, saving energy;

wherein the scan comprises the steps of:

a) setting a set of vertical louvers at a central position and a set of horizontal louvers at a far top position, and with the HVAC system on, the zonal temperature is recorded by the portable tag for a set period of time; b) moving the set of horizontal louvers from the far top to a far bottom position for a full vertical scan, and by a plurality of step changes in an angle of the louvers, while holding the set of horizontal louvers at each step change in an angle for a holding period of time for the zonal temperature to stabilize, and recording a set of zonal temperatures and assigning each zonal temperature recorded to each angle of the set of horizontal louvers during the full vertical scan; c) determining a minimum in a cooling process or a maximum in a heating process of the set of zonal temperatures recorded; d) determining a gradient of the zonal temperature minimum or the maximum by a difference between a present and a past minimums or maximums; e) if the gradient of a minimum tag temperature is negative, the tag temperature is decreasing and there may be a lower temperature point, which is desired in a cooling process, and the set of vertical louvers are turned left by a step angle; f) repeating steps (b), (c) and (d) until the gradient of the minimum tag temperature is positive; g) if the gradient of the minimum tag temperature is positive, a previous tag temperature was lower and the louvers have passed a minimum point, then the vertical louvers are turned right by a step angle, and proceed to step (g); h) the vertical louver angle that provides the minimum tag temperature, corresponds to the horizontal location of the tag in the space; i) with a fixed vertical louver angles, the horizontal louvers scan the space to find the minimum tag temperature at a point that negative gradient converts to positive gradient, j) the louvers angles so obtained provided the minimum air temperature to the tag location.

2. The system of claim 1, wherein the smart air panel comprising:

a) a panel body;

b) a set of horizontal and vertical louvers rotatably installed on the panel body, and c) a rotating mechanism to rotate the set of horizontal and vertical louvers.

3. The system of claim 2, wherein the rotating mechanism comprising of a set of motors to operate a rack-and-pinion, or a screw-gear or a gear-and-belt mechanism to move the set of horizontal and vertical louvers.

4. The system of claim 1, wherein the portable tag comprises of a temperature sensor.

5. The system of claim 1, having a plurality of smart air panels to control a plurality of zonal temperatures measured by a plurality of portable tags.

6. The system of claim 1, further having an application installed on a mobile phone that is configured to communicate with the processer to allow a user to manually move the set of louvers of the smart air panel to a desired direction of the user.

7. The system of claim 1, wherein the portable tag is a temperature sensor of a mobile phone.

8. The system of claim 1, having a plurality of smart air panels and a plurality of portable tags, wherein each smart air panel is paired with a corresponding portable tag, and wherein one of the plurality of the portable tags are set as a master tag, and wherein the master tag communicates with the smart thermostat to control the temperature of the zone corresponding to the master tag, and wherein the zonal temperatures of the plurality of the zones of the plurality of the tags are controlled by movement of the set of horizontal and vertical louvers of the corresponding smart air panel.

9. The system of claim 1, wherein the set of horizontal and vertical louvers is divided into a first section and a second section, and the set of motors are placed in between the first and the second sections.

10. The system of claim 1, further having a remote control to remotely control the louver movement, wherein the remote control may use RF or IR systems.

11. The system of claim 1, having a plurality of smart air panels and a plurality of portable tags, wherein each smart air panel is paired with a corresponding portable tag, and wherein one of the plurality of the portable tags are set as a master tag, and wherein the master tag communicates with the smart thermostat to control the temperature of the zone corresponding to the master tag, and wherein the zonal temperatures of the plurality of the zones of the plurality of the tags are controlled by movement of the set of horizontal and vertical louvers of the corresponding smart air panel.

12. The system of claim 1, further having a thermal camera installed on the smart air panel that takes a thermal image of the space, and the processor is configured to identify a location of a person in the space through an image analysis of the thermal image, resolve the location of the portable tag with the location of the person, and target air flow towards the person.

13. A method of controlling a zonal temperature of a zone in a space that is controlled by an HVAC system, using a smart air panel that has a set of vertical and a set of horizontal louvers, a portable tag having a temperature sensor, a smart thermostat and a processor, the method comprising steps of:

a) turning on the smart air panel when the portable tag enters into the space;

b) reading the zonal temperature by the portable tag and communicating it with the processor;

c) scanning the space through a scanning process by moving the set of horizontal and vertical louvers of the smart air panel to find a location of the portable tag;

d) fixing a direction of the set of horizontal and vertical louvers of the smart air panel towards the portable tag;

e) communicating the zonal temperature with the smart thermostat; and f) controlling operation of the HVAC with the smart thermostat using the zonal temperature;

wherein fixing the direction of the set of moving lovers towards the portable tag is through a gradient descent optimization method, comprising the steps of: a) choosing a starting state of the set of horizontal and vertical louvers; b) rotating the set of horizontal and vertical louvers by a scaled step in a first direction; c) reading the zonal temperature provided by the portable tag; d) calculating a zonal temperature gradient based on the zonal temperatures; e) identifying a first location when the zonal temperature gradient is equal or more that a predetermined temperature gradient; f) rotating the set of horizontal and vertical louvers in a second direction, opposite to the first direction, and making a scaled step in the second direction; g) repeating steps (c) to (f) and until either a set temperature gradient is reached or a maximum number of rotating the set of horizontal and vertical louvers is reached, h) fixing the direction of the set of horizontal and vertical louvers of the smart panel at a final setting as found in step g, and identifying it as a tag location.

14. The method of claim 13, wherein the scanning process comprises steps of:

a) setting the set of vertical louvers at a central position and the set of horizontal louvers at a far top position, and with the HVAC system on, the zonal temperature is recorded by the portable tag for a set period of time;

b) moving the set of horizontal louvers from the far top to a far bottom position for a full vertical scan, and by a plurality of step changes in an angle of the louvers, while holding the set of horizontal louvers at each step change in an angle for a holding period of time for the zonal temperature to stabilize, and recording a set of zonal temperatures and assigning each zonal temperature recorded to each angle of the set of horizontal louvers during the full vertical scan;

c) determining a minimum in a cooling process or a maximum in a heating process of the set of zonal temperatures recorded;

d) determining a gradient of the zonal temperature minimum or the maximum by a difference between a present and a past minimums or maximums;

e) if the gradient of a minimum tag temperature is negative, the tag temperature is decreasing and there may be a lower temperature point, which is desired in a cooling process, and the set of vertical louvers are turned left by a step angle;

f) repeating steps (b), (c) and (d) until the gradient of the minimum tag temperature is positive;

g) if the gradient of the minimum tag temperature is positive, a previous tag temperature was lower and the louvers have passed a minimum point, then the vertical louvers are turned right by a step angle and go to step (g);

h) where a vertical louver angle that provides the minimum tag temperature, corresponds to a horizontal location of the tag in the space;

i) with fixed vertical louver angles, the horizontal louvers scan the space to find the minimum tag temperature at a point that the negative gradient converts to the positive gradient, and j) the louvers angles so obtained provide a minimum air temperature to the tag location.

15. The method of claim 13, wherein the starting state for the set of horizontal and vertical louvers is set to the final setting that us stored in the processor from a prior scan, thereby expediting a tag location determination.

16. The method of claim 13, closing the set of horizontal and vertical louvers to prevent air flow from the HVAC system into the space if there is no portable tag in the space.

17. The method of claim 13, wherein the set of horizontal and vertical louvers can be set as a direct flow or an indirect flow, wherein the direct flow sets the set of horizontal and vertical louvers to direct air directly towards the portable tag, and the indirect flow sets the set of horizontal and vertical louvers at a set of angles that direct air to a neighborhood of the portable tag.

18. The method of claim 17, wherein in the indirect flow the louvers are set to oscillate around the portable tag location.

19. The method of claim 13, adjusting the set of angles of the set of horizontal and vertical louvers to change the zonal temperature recorded by each portable tag in a multi-tag system in the space with a plurality of smart air panels, thereby each smart air panel sustains a different zonal temperature, and wherein a master tag is used to communicate with the smart thermostat and control the HVAC system.

* * * * *